US005524602A

United States Patent [19]

Papandrea et al.

[11] Patent Number: 5,524,602

[45] Date of Patent: Jun. 11, 1996

[54] GYRO-KINETIC HYDRAULIC BOW STABILIZER

[76] Inventors: Tim M. Papandrea, 141 D-Debbie Ct., Chester, N.Y. 10918; Donald A. Schlosser, 153 Blue Sky Manor, Wurtsboro, N.Y. 12790

[21] Appl. No.: 243,820

[22] Filed: May 17, 1994

[51] Int. Cl.[6] ..... F41B 5/20

[52] U.S. Cl. ..... 124/89

[58] Field of Search ..... 124/23.1, 89

[56] References Cited

U.S. PATENT DOCUMENTS

| | | | |
|---|---|---|---|
| 4,150,819 | 4/1979 | Taylor | 267/136 |
| 4,570,608 | 2/1986 | Masterfield | 124/89 |
| 4,615,327 | 10/1986 | Saunders | 124/89 |
| 4,632,228 | 12/1986 | Oster et al. | 188/282 |
| 4,660,538 | 4/1987 | Burgard | 124/89 |
| 4,893,606 | 1/1990 | Sisko | 124/89 |
| 4,945,666 | 8/1990 | Henry et al. | 124/89 X |
| 4,982,719 | 1/1991 | Haggard et al. | 124/89 |
| 4,986,018 | 1/1991 | McDonald, Jr. | 124/89 |
| 5,044,351 | 9/1991 | Pfeifer | 124/89 |
| 5,385,136 | 1/1995 | Thomas | 124/89 |
| 5,388,563 | 2/1995 | Hsu | 124/23.1 |

*Primary Examiner* John A. Ricci
*Attorney, Agent, or Firm* McGlew and Tuttle

[57] ABSTRACT

A Gyro-Kinetic Hydraulic Bow Stabilizer disclosed for the reduction of random force exerted by a state of the art compound bow. A piston assembly (quadraulic unit) includes a hollow cavity cylindrical chamber, calculated tension spring, opposing poller pistons, retaining ring and fasteners, along with a viscous fluid in a capsule housing. The housing includes a cylinder tube closed at both ends by secured caps, and attached at one end by an energy transferring mounting bolt. The quadraulic unit moves laterally along the elongation direction of the stabilizer and contacts a piston rod portion of said poller pistons against a cap wall of the housing, developing multiple hydraulic events. Conventional lateral stabilization, which exists along with internal stabilization of the hollow cavity, fires pressurized tuned ports of different axial orientation on the outer periphery of the quadraulic unit. The following reaction absorbs force multi-directionally and floats the quadraulic unit in a viscous fluid as the energy dissipates. Counter channeling of the viscous fluid allows reduction in stabilizer size.

8 Claims, 2 Drawing Sheets

GYRO-KINETIC HYDRAULIC BOW STABILIZER

BACKGROUND OF THE INVENTION

This invention related to hydraulic bow stabilizers which are used to minimize archery bow vibration and reduce reflex response error.

DESCRIPTION OF THE PRIOR ART

Since its inception archery has been as demanding to man as man has been to archery. In the pioneering days of the sport, it was most difficult to maintain a consistent group of arrows or execute the perfect shot at smaller game at long distance. Eventually, with the ingenuity of man, the first bow stabilizers appeared. Through the years they developed to finer level giving one greater satisfaction until modern technology took hold. In most recent years, compound bow design has developed into state of the art, incorporating space age materials from limb to limb. Exotic materials can be found in everything, from the bow string to the arrows themselves. This has given rise to a marked increase in bow speed. Bow stabilizers, one small leap, can continue to improve to stay abreast of modern technology.

In the prior art, referring to U.S. Pat. Nos. 4,615,327 and 4,660,538, although they are of fine resilient and inertial design respectively, they may not be enough to dissipate the non-typical energy of current high speed bows. Referring to U.S. Pat. Nos. 4,150,819; 4,570,608; 4,632,228; 4,893,606; 4,982,719; 4,986,018 and 5,044,351, here again, we have quality examples of engineering and dedication to the art. The one existing commonalty, between the above mentioned, being main stream hydraulic theory, all function in a uniform lateral shock absorbing action. The small internal complexity of some of these units, including those that are fixed along the tube wall, may not absorb any energy other then the pre-stated lateral force.

One prior art acknowledgment has been made in recognition of non lateral forces exerted by a bow. A fine incorporation of hydraulics and the use of external counter weights, at the sacrifice of compactness.

With engineering, including pressurized non linear secondary hydraulic action, this can be done inside the stabilizer. Through experimentation, one can develop a system that reacts to forces from all directions.

Small prior art units may not have enough mass to overcome the power of a performance bow. Units with enough mass may be rather lengthy (a disadvantage in the field) and have limited appeal to many archers. The advantages of pure linear stabilizers are greatly reduced with current bow speeds exceeding 300+ F.P.S. A multi functional stabilizer is unquestionably in order.

SUMMARY OF INVENTION

In this invention, a primary objective is to develop counter firing non-linear stabilization in series with conventional hydraulic stabilization, to make available a hydraulically suspended device in an enclosed capsule housing. The result would be the transference of kinetic energy in a gyroscopic manner.

Another objective of the invention, is the incorporation of a preferred specially designed chamber allowing the use of four hydraulic ports. They in turn, exit viscous fluid under pressure against the walls of a capsulated housing. As a unit, the chamber incorporates a calculated tension spring, two energy absorbing low durometer pistons, a retaining ring and retaining screws. The above being acted upon in a linear hydraulic method, produces counter firing hydraulic action.

Another objective of the invention, is the reduction of size with increased sensitivity. We can dramatically reduce the preferred unit to approximately four inches or less, making it ultra compact. Bow force is absorbed omni-directionally with no need for the typical extended lateral movement, making a stabilizer excessively long.

Another objective of the invention, is the usage of a special mounting bolt. Having a wide flat base, it is secured to the mounting cap rigidly to aid in the transfer of energy evenly across the stabilizer.

The objects presented here along with other features and applicable characteristics, can be best understood facilitating the following drawings, brief description, and ensuing detailed description.

DETAILED DESCRIPTION OF THE INVENTION

Figure 1:
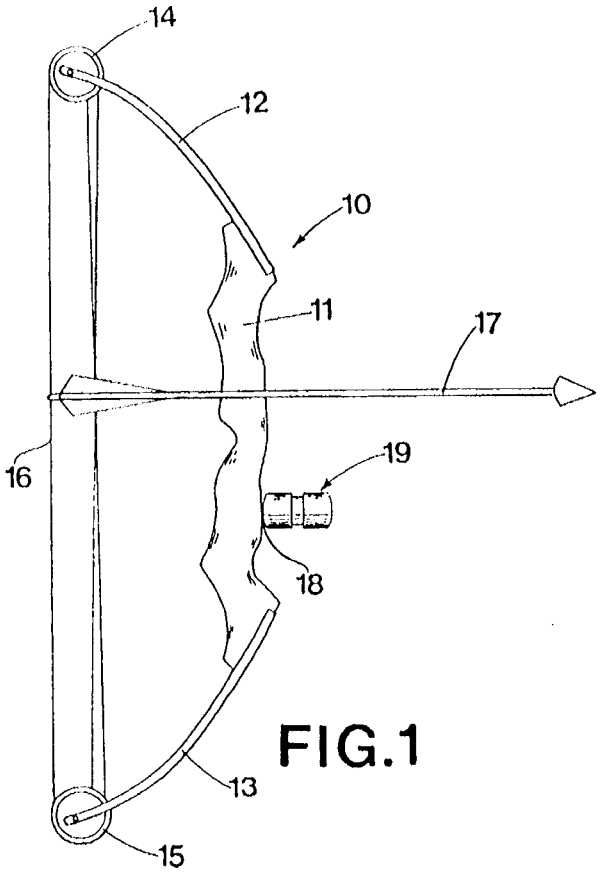
FIG. 1 shows a side elevational view of the stabilizer, in accordance to the present invention, mounted on a compound bow.

Directed to FIG. 1, the reference numeral 10 designates a state of the art compound bow. The bow 10 is constructed of a riser 11, a composite upper limb 12, a composite lower limb 13, an upper eccentric wheel 14, a lower eccentric wheel 15, and a string 16. The string 16, of exotic material, through guided channels connects the eccentric wheels 14 and 15. The stabilizer, generally referred to as numeral 19, is threaded into the bow riser 11 typically located at the mounting bolt 18. When an archer draws back and releases the string 16, an arrow 17 is launched in a forward direction; to the right of the page. During this operation, the eccentric wheels 14 and 15 release energy in a specifically timed manner. Unlike a conventional bow whose power curve is proportional. The bow energy is stored in the composite limbs 12 and 13 and released instantaneously, unlike a conventional bow where energy transfer is slower.

All bow force cannot be absorbed by the arrow 17, in turn, it must be dissipated by an archers hand or a mounted stabilizer. Obviously, the first is not acceptable with a high caliber bow, this would not lead to consistent accuracy. Choosing the later, the stabilizer 19 must be rigidly mounted to the bow 10, to smoothly transfer stored energy.

Figure 2:
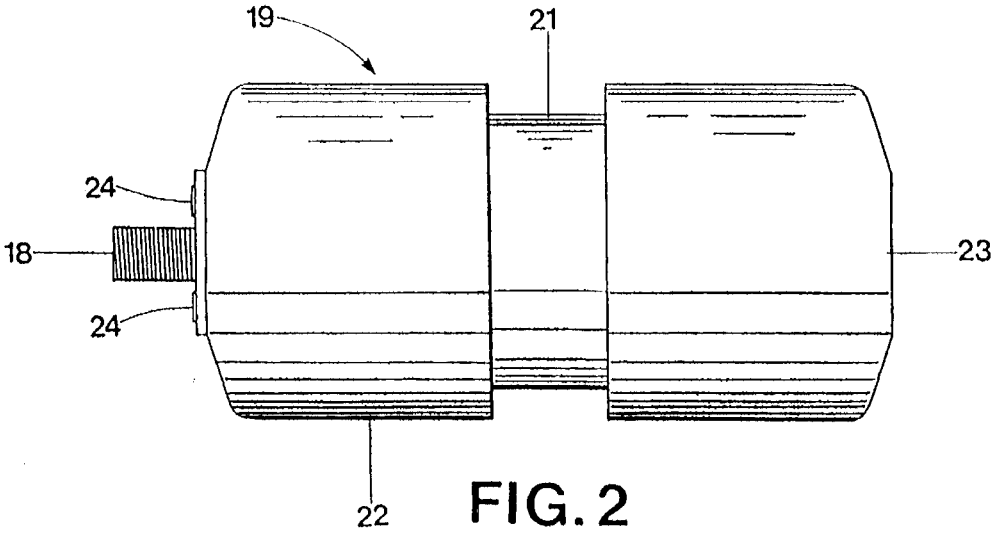
FIG. 2 shows an enlarged side elevational view of the stabilizer first shown in FIG. 1.

FIG. 2 Shows us an external view of the stabilizer 19 along with bolt 18, which evenly distributes bow energy. The stabilizer 19, in its preferred form, is cylindrical in shape. Also shown here are mounting cap 22 and end cap 23, assembled together at opposite ends of a cylindrical tube 21. Together these elements comprise eighty percent or more of the overall length. This gives the stabilizer 19 great strength and added density across the circumference.

Figure 3:
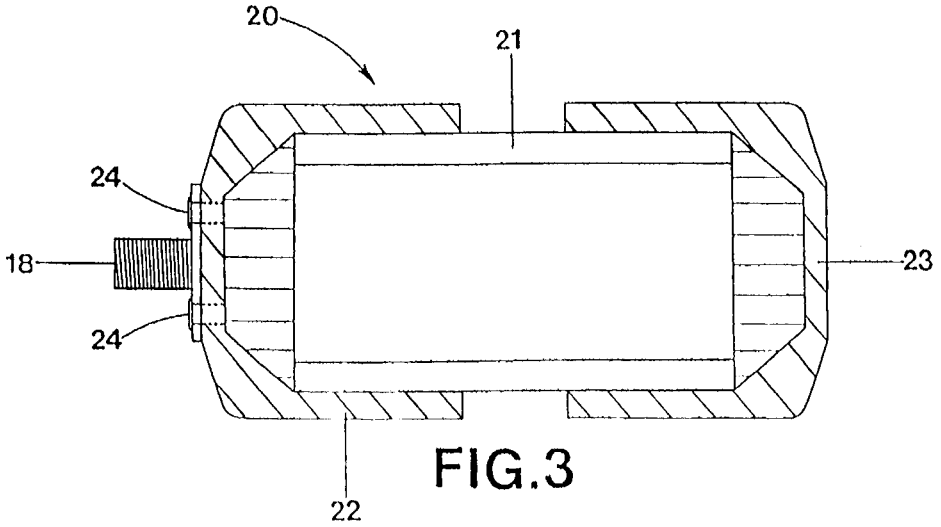
FIG. 3 shows a cross-sectional view of the stabilizer's capsule housing whose exterior is shown in FIG. 2.

Directing attention to FIG. 3, we take a cross-sectional look at the stabilizers cylindrical outer shell, the capsule housing 20. The structure comprised of a hollow cylindrical tube 21, rigidly secured at both ends by the mounting cap 22 and end cap 23. We can better see the mounting bolt 18 constructed of metal secured to the mounting cap 22 by several fasteners 24, also constructed of metal.

Figure 4:
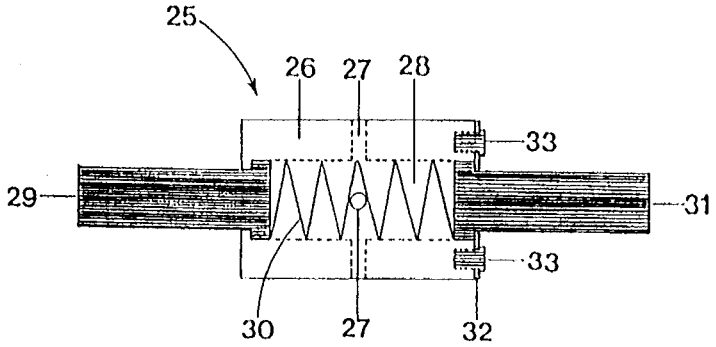
FIG. 4 shows a cross-sectional view of the completed chamber, designated: Quadraulic unit, in accordance to the present invention.

FIG. 4 Shows us a completed quadraulic unit 25 which acts as a piston within a piston, giving us a multiple of hydraulic events. The development of the system begins with the chamber 26, which in its preferred form is constructed of dense metal, cylindrical in design. Half way the length, equidistant across the outer periphery, four tuned ports 27 exist through the chamber 26. The ports 27 terminate into a measured hollowed cavity 28, on center, parallel the length of the chamber 26.

In one end of the chamber 26, a piston 29, having one end diameter, or a piston head diameter, larger than that of the central portion, is inserted. A tension spring 30, whose bias is determined, follows in the cylindrically hollow cavity 28. Opposing a second piston 31 is inserted, capped by a retaining ring 32, secured to the chamber 26 by fastening screws 33. The pistons 29 and 31, in preferred form, are made from durometer measured polymer which perform a quiet, sealed, pressurizing operation.

Figure 5:
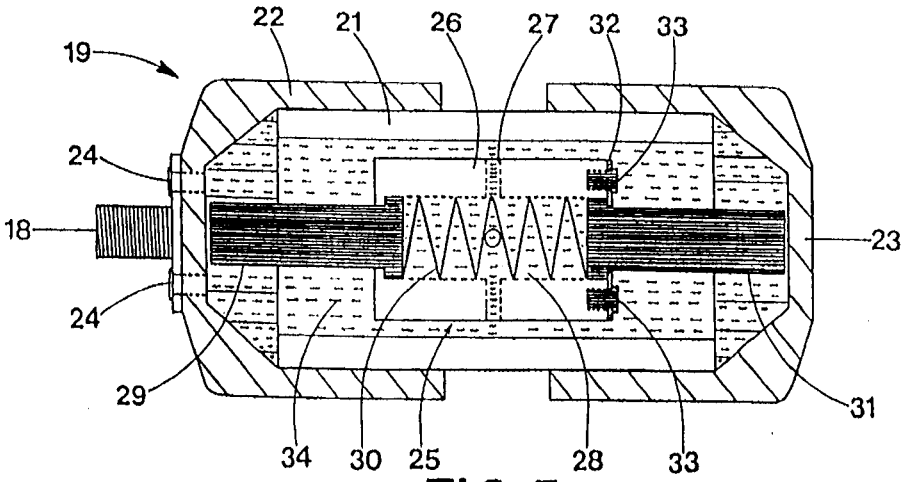
FIG. 5 shows a cross-sectional view of the completed stabilizer, in accordance to the present invention, comprised of a capsule housing shown in FIG. 2 and FIG. 3, a quadraulic unit shown in FIG. 4 and added viscous fluid.

Directing attention to FIG. 5, we see the cross-sectional workings of the gyro-kinetic stabilizer 19. Enclosed within the cylindrical tube 21, secured by mounting cap 22 and end cap 23, is situated the quadraulic unit 25 with viscous fluid 34. Also shown is mounting bolt 18 secured by fasteners 24.

When a bow 10 such as in FIG. 1, is fired, stored energy is transferred into the stabilizer 19. This in turn, activates the weighed quadraulic unit 25 into a lateral motion, left and right of page. The viscous fluid 34 which occupies most of the internal remaining space of the stabilizer 19, also occupies the hollow cavity 28 and tuned ports 27. Upon the transfer of energy, the initial response is that of a conventional lateral hydraulic stabilizer.

Making contact with either cap 22 or 23, the pistons 29 or 31 eject a viscous fluid 34 under pressure through tuned ports 27, cycling a four stage hydraulic event.

The first stage hydraulic event is the lateral transfer of the quadraulic unit 25 through the viscous fluid 34 of stabilizer 19.

The second stage hydraulic event is the lateral transfer of viscous fluid 34 through the hollow cavity 28 of the quadraulic unit 25.

The third stage hydraulic event is the pressurized ejection of viscous fluid 34 through fifty percent of the tuned ports 27. In their preferred form, they are situated in plane around the outer periphery of the chamber 26, ninety degrees to the other ports.

The fourth stage hydraulic event is the pressurized ejection of viscous fluid 34, through the remaining ports 27, existing on a different plane, counter balancing the quadraulic unit 25.

The summation of the ejected viscous fluid 34 in the third and fourth stage hydraulic events, create a lifting of the quadraulic unit 25. Depending on the direction of kinetic energy, the lifting becomes gyroscopic in nature self biasing pressure against the inner cylindrical tube 21 wall. The interior of the cylindrical tube 21 being slightly larger than the external diameter of the chamber 26.

The ports 27, not only aide in stabilization, they also act as buffered sound absorbers, constantly transferring fluid under pressure, counter to the lateral movements supporting the quadraulic unit 25.

To further aide in sound and energy absorption, incorporated is the use of durometer measured polymer pistons 29 and 31. Absorbing initial shock when contacting caps 22 and 23, they are separated by a tension spring 30. This spring 30, has a calculated biasing action in that the load rate is slower than the rate of release. This makes response time to opposing force almost immediate. Securing these components in the chamber 26 is a retaining ring 32 and fastening screws 33.

The ergonomical design of the stabilizer 19 as shown, leads to compact, extremely efficient, progressive multipoint stabilization. No sacrifice has been made to strength and integrity.

Although the present invention is disclosed in its preferred embodiment, it should not limit the scope of the invention as many modifications would come forth and thus the true scope should be determined with the following claims rather than solely by illustration.

What is claimed is:

1. A bow stabilizer comprising;

a housing having a longitudinal direction and a radial direction;

fastening means connected to said housing and for attaching said housing to a bow;

longitudinal stabilizing means positioned inside said housing and for absorbing kinetic energy from the bow substantially along said longitudinal direction, said longitudinal stabilizing means including a weight movable in said longitudinal direction, a piston movable with respect to said weight, biasing means for biasing said piston in a steady state position, hydraulic means for resisting movement of said piston and for resisting longitudinal movement of said weight with respect to said housing;

radial stabilizing means positioned inside said housing and for absorbing kinetic energy from the bow substantially along said radial direction, said radial stabilizing means including radial movement means for moving said weight of said longitudinal means in substantially said radial direction, said radial stabilizing means also including radial resistance means in said hydraulic means for resisting movement of said weight in said radial direction, said radial stabilizing means also including radial jet means for radially ejecting fluid from said weight.

2. A bow stabilizer in accordance with claim 1, wherein:

said weight defines a chamber;

said piston includes a piston head and a piston rod, said piston head being positioned inside said chamber, said piston rod extending out of a longitudinal end of said weight;

a spring is positioned in said chamber and biases said piston outward from said weight.

3. A bow stabilizer in accordance with claim 2, wherein:

said radial jet means includes a port defined by said weight and extending radially from said chamber to a radial outer side of said weight, said fluid being a viscous fluid and communicating through said port when said piston moves with respect to said weight.

4. A bow stabilizer in accordance with claim 3, wherein:

said radial jet means includes a plurality of said ports positioned substantially symmetrically in a radial plane.

5. A bow stabilizer in accordance with claim 2, wherein:

another piston is positioned inside said housing and includes a piston head positioned inside said chamber, said another piston also includes a piston rod extending out of another longitudinal end of said weight, said spring biasing said another piston outward from said weight in a direction substantially opposite to said piston.

6. A bow stabilizer in accordance with claim 5, wherein:

said radial jet means includes a port defined by said weight and extending radially from said chamber to a radial outer side of said weight, said port being positioned between said longitudinal ends of said weight, said fluid being a viscous fluid and communicating through said port when one of said piston and said another piston moves with respect to said weight.

7. A bow stabilizer in accordance with claim 6, wherein:

said radial jet means includes a plurality of said ports positioned substantially symmetrically in a radial plane.

8. A bow stabilizer in accordance with claim 6, wherein:

said port is positioned substantially halfway between said longitudinal ends of said weight.

* * * * *